US005603194A

United States Patent [19]

Fridlyand et al.

[11] Patent Number: 5,603,194

[45] Date of Patent: Feb. 18, 1997

[54] APPARATUS FOR RETROFITTING AN EXISTING DOOR TO PROVIDE A FIRE RATING TO THE UNRATED EXISTING DOOR

[75] Inventors: Semyon Fridlyand, Willowdale; George Perlin, North York, both of Canada

[73] Assignee: Eveready Exact Closures Inc., Concord, Canada

[21] Appl. No.: 533,063

[22] Filed: Sep. 25, 1995

[30] Foreign Application Priority Data

Dec. 7, 1994 [CA] Canada ..... 2137499

[51] Int. Cl.[6] ..... E04B 1/62; E06B 3/30

[52] U.S. Cl. ..... 52/515; 52/784.11; 52/741.3; 52/745.16; 52/746.1; 49/460; 49/501; 70/417; 70/450; 109/49.5

[58] Field of Search ..... 52/515, 784.1, 52/784.11, 784.12, 741.3, 745.16, 746.1; 49/501, 460; 109/49.5, 85; 70/417, 450, 452; 292/346

[56] References Cited

U.S. PATENT DOCUMENTS

| | | | |
|---|---|---|---|
| 2,489,072 | 11/1949 | Ausubel | 16/DIG. 2 X |
| 2,631,881 | 3/1953 | Trachsler | 292/346 |
| 3,386,209 | 6/1968 | Starcevic | 49/501 |
| 3,673,605 | 6/1972 | Allenbaugh | 292/346 |
| 4,263,752 | 4/1981 | Jungbluth | 49/501 |
| 4,270,326 | 6/1981 | Holter et al. | 52/784.11 X |
| 4,372,364 | 2/1983 | Katz | 49/460 X |
| 4,397,168 | 8/1983 | Rotondi et al. | 70/452 X |
| 4,415,191 | 11/1983 | Thorp | 292/346 |
| 4,489,663 | 12/1984 | Poag et al. | 52/784.11 X |
| 4,517,779 | 5/1985 | Dunsworth | 52/232 |
| 4,780,163 | 10/1988 | Haneline, Jr. et al. | 156/94 |
| 4,799,349 | 1/1989 | Luckanuck | 52/784.11 |
| 4,888,918 | 12/1989 | Green et al. | 49/501 |
| 5,053,107 | 10/1991 | Barber, Jr. | 162/145 |
| 5,154,461 | 10/1992 | Prescott et al. | 292/346 |
| 5,269,100 | 12/1993 | Fontenot | 49/460 |

FOREIGN PATENT DOCUMENTS

| | | | |
|---|---|---|---|
| 2567565 | 1/1986 | France | 49/460 |
| 2519666 | 11/1976 | Germany | 49/501 |
| 561879 | 11/1943 | United Kingdom | 52/784.1 |

*Primary Examiner*—Carl D. Friedman
*Assistant Examiner*—Laura A. Saladino

[57] ABSTRACT

The present invention provides for an apparatus for retrofitting an existing wooden door having opposing surfaces to upgrade the fire rating of the existing door. The apparatus includes a door cover steel sheet having a non-combustible insulating coating on an interior surface for coveting at least one surface of the door and a lock set reinforcement bracket having a non-combustible insulating coating on an interior surface for surrounding the lock set opening on an opposing surface of the door, the apparatus providing at least a twenty minute fire rating to the retrofitted door. In an aspect of the invention, there is provided a method for increasing the fire rating of a door having opposing surfaces. The method comprises attaching to a first surface of the door, a door cover steel sheet having a non-combustible insulating coating on an interior surface to cover the entire surface of the door and attaching to a second surface of the door, a lock set bracket having a non-combustible insulating coating on an interior surface to surround at least a lock set opening in the second surface of the door, the modified door having at least a twenty minute fire rating.

14 Claims, 2 Drawing Sheets

APPARATUS FOR RETROFITTING AN EXISTING DOOR TO PROVIDE A FIRE RATING TO THE UNRATED EXISTING DOOR

FIELD OF THE INVENTION

The present invention relates to an apparatus for attachment to a non-fire rated wooden door for retrofitting the door to provide for at least twenty minute fire rating for such door.

BACKGROUND OF THE INVENTION

Present regulations in many jurisdictions require that doors in public building have at least a twenty minute fire rating. This rating provides that the door should act as a fire break to prevent passage of the fire through the door for at least a period of twenty minutes. Some jurisdictions also have regulations requiring upgrading of fire protection ratings of existing doors in existing buildings either at time of renovation of the space or, in some cases, within a fixed period of time. Up to the present time, in order to upgrade the fire protection rating of the door, it has been necessary to replace the existing door by a new fire rated door. In some instances, replacement of such doors may be difficult and may require replacement of the frame of the doors as well. In addition, in unique historic buildings, the replacement of the doors is also difficult due to the unique value of the existing doors. It would thus be desirable to have a means of upgrading existing doors in a building to the proper fire rating.

SUMMARY OF THE INVENTION

The present invention provides for an apparatus for retrofitting an existing wooden door to upgrade the fire rating of the existing door. The apparatus comprises a door cover steel sheet having a non-combustible insulating coating on an interior surface for covering at least one surface of the door and a lock set reinforcement bracket having a non-combustible insulating coating on an interior surface for surrounding the lock set opening on the opposite surface of the door, the apparatus providing at least a twenty minute fire rating to the retrofitted door.

In an aspect of the invention, there is provided a method for increasing the fire rating of a door. The method comprises attaching to one surface of the door, a door cover steel sheet having a non-combustible insulating coating on an interior surface to cover the entire surface of the door and attaching to the second surface of the door, a lock set bracket having a non-combustible insulating coating on an interior surface to surround at least the lock set opening in the surface of the door, the modified door having at least a twenty minute fire rating.

BRIEF DESCRIPTION OF THE DRAWINGS

Preferred embodiments of the invention are shown in the drawings, wherein.

DETAILED DESCRIPTION OF THE PREFERRED EMBODIMENTS

Figure 1:
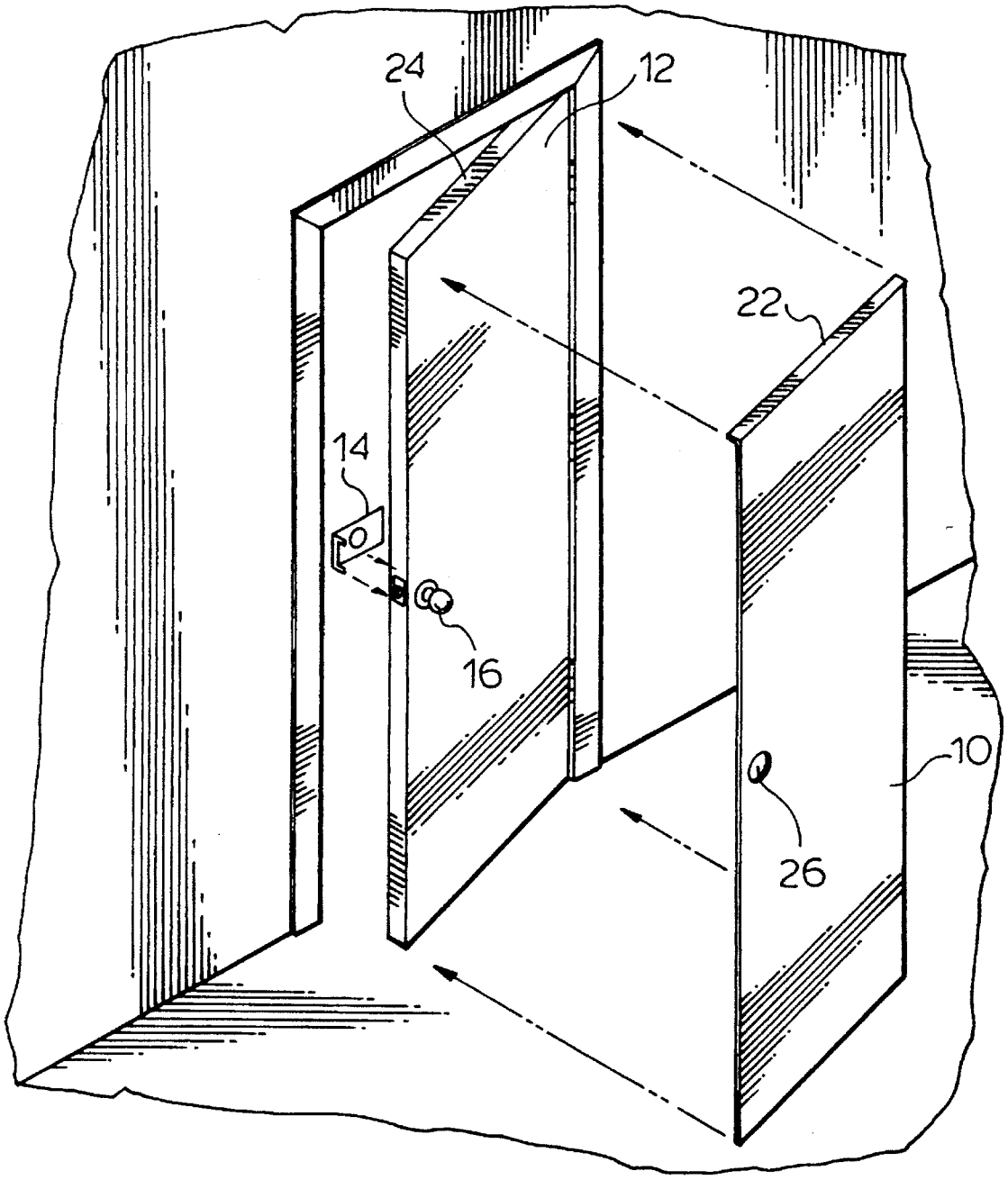
FIG. 1 is an exploded perspective view of the apparatus of the present invention for attachment to an existing door.
Figure 2:
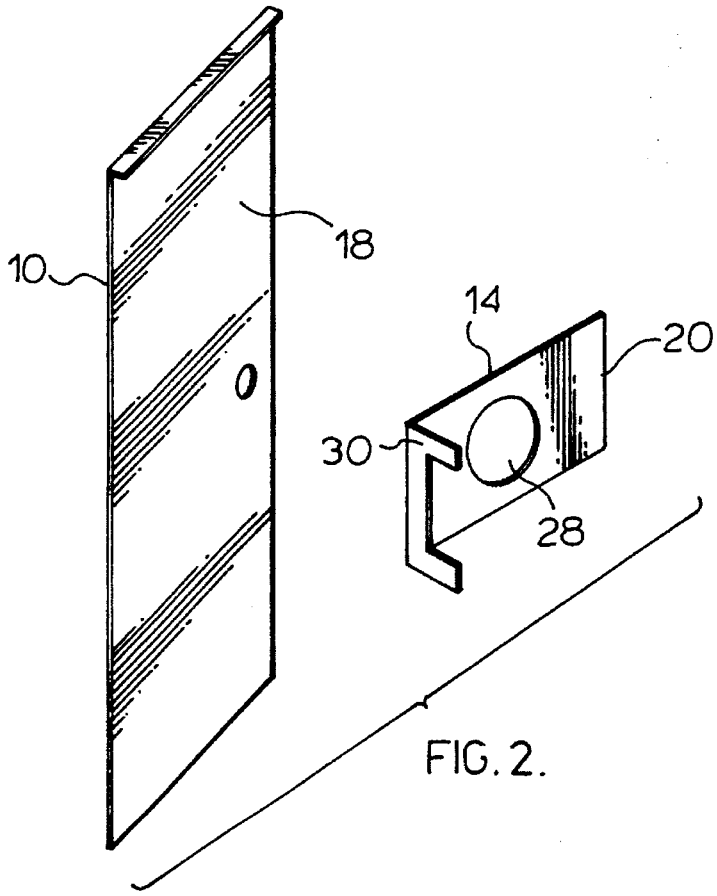
FIG. 2 is a perspective view of the apparatus of the present invention.
Figure 3:
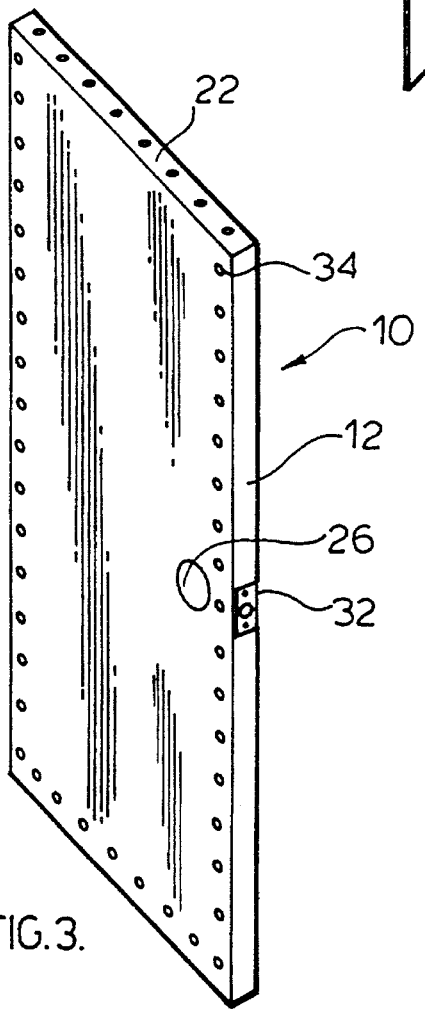
FIG. 3 is a perspective view of the steel sheet attached to a door.
Figure 4:
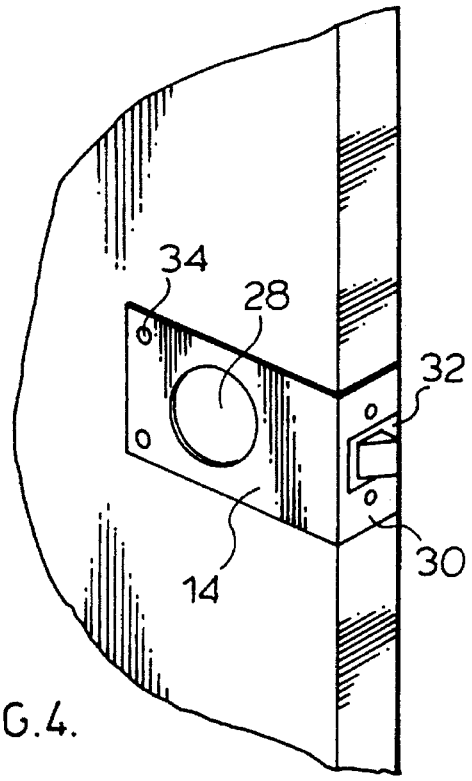
FIG. 4 is a perspective view of the lock set protector;attached to a door.

The apparatus of the present invention for retrofitting an existing wooden door to upgrade the fire rating of the existing door is illustrated in the attached Figures. The apparatus comprises a door cover steel sheet 10 for covering at least one surface of an existing wooden door 12 and a lock set reinforcement bracket 14 for surrounding at least the lock set opening 16 of the door 12 on the other surface of the door 12.

The door cover steel sheet 10 is preferably of a 22 to 24 gauge to provide for a minimum twenty minute fire rating of the door 12. For a minimum twenty minute fire rating it has been found that the steel sheet is preferably of 24 gauge.

To improve the fire rating performance of the door, the interior surface 18 of the door cover steel sheet 10 is provided with a thin layer of non-combustible insulating material. The presence of the insulating material on the interior surface 18 of the door cover steel sheet 10 retards the ignition of the wooden door 12 under fire conditions by blocking the conductivity of the heat through the door cover steel sheet 10. Similarly, the lock set reinforcement bracket 14 is also provided with a thin layer of non-combustible insulating material on the interior surface. The non-combustible insulating material is chosen to provide for proper insulation of the wooden door 12 from the thermal conductivity of the door cover steel sheet 10. Preferably, the non-combustible insulating material is selected from ceramics or mineral type insulation, more preferably, the non-combustible insulating material is ceramic paper, most preferably 1/32 inch thick.

Door cover steel sheet 10 is preferably provided with a folded lip 22 at the top of the sheet to cover the upper edge 24 of the door 12. If desired, although not necessary, a similar folded lip or tab may be provided for the lower or side edges of the door 12. If also desired, a folded lip may be provided at the side edge to underlay the hinge plate on the side edge of the door 12 to provide for joining of the steel sheet 10 to the hinge plates of the door. Provision of such a lip may further increase the fire rating of the retrofitted door 12.

Door cover steel sheet 10 is provided with a suitable opening 26 for lock set 16. For standard doors, this opening 26 may be preformed in the steel sheet 10 or the opening 26 may be cut on site in the proper location with the use of a suitable hole saw. Lock set reinforcement bracket 14 is also provided with a circular opening 28 for passage of the lock set 16 and is provided with a lip 30 to surround the latch plate 32 of the lock set 16. This lip 30 as illustrated in the Figures as a general U-shape to surround the latch plate 32 of the lock set 16. It has been found that such a shape provides the proper fire rating for the door 12. If desired, this lip 30 may be formed to have a rectangular opening surrounded on all sides by metal to increase the amount of metal surrounding the latch plate 32.

The apparatus for upgrading the fire rating of the existing door of the present invention may be attached to the door through any suitable means such as screws or adhesive and screws 34. If an adhesive is used, it may be preferred to be a relatively high-temperature adhesive such that the adhesive will not quickly melt in the high temperatures encountered in a fire and permit separation of the door cover steel sheet covering 10 or lock set reinforcement bracket 14 from the door 12. However, as the adhesive does not alone hold the apparatus to the door but is generally only used during the installation, ordinary carpenter adhesive may be used.

The door cover steel sheet 10 and lock set reinforcement bracket 14 are preferably attached to the door through use of suitable screws 34 and the adhesive. Preferably the screws 34 are stainless steel screws chosen because of their lower thermal conductivity to limit the deterioration of the wood into which they are attached under fire conditions. As illustrated in the Figures, the door 12 may be retrofitted without having to remove the door 12 from the hinges. In these circumstances, the lock set 16 is removed from the door 12, a suitable adhesive is applied to one surface of the door 12 and door cover steel sheet covering 10 is applied to the face of the door and fastened by means of the stainless steel screws 34. The coated lock set reinforcement bracket 14 is preferably applied to the other side of the door 12 through the use of stainless steel screws 34 although if desired adhesive may also be used. At this point, the lock set 16 is then replaced and the door 12 is available for use. Alternatively, if tabs or a lip is provided to underlay the hinge plate on the door 12, the door 12 is unhung from the frame, hinge plates removed and then replaced after the door cover steel sheet 10 has been applied, as described above.

One benefit of the retrofitting method of the present invention is that has been found that it is only necessary to completely cover one surface of the door with the door cover steel sheet in order to achieve the required minimum twenty minute fire rating. This is important for retrofitting of buildings having unique doors in that the interior surface of the door is covered with the door cover steel sheet and the exterior surface is not modified to a great degree, thus retaining its aesthetic appeal. In addition, if desired, decorative panels or other decoration to match the original appearance of the door may be applied to the door cover steel sheet to mimic the appearance of the door. This allows for wider latitude of decoration of the door not only in retrofit applications but also in new construction.

The use of the apparatus of the present invention also increases the security of the door by increasing the resistance of the doors to impact and break-ins.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. An apparatus for retrofitting an existing door having opposing exterior surfaces to upgrade the fire rating of the door, the apparatus comprising a door cover steel sheet having a non-combustible insulating coating on an interior surface for covering at least one surface of a door and a lock set reinforcement bracket having a non-combustible insulating coating on an interior surface for surrounding a lock set opening on an opposing surface of the door, the apparatus providing at least a twenty minute fire rating to a retrofitted door.

2. An apparatus as claimed in claim 1 wherein the door cover steel sheet is provided with a folded lip at a top edge for overlaying a top edge of the door.

3. An apparatus as claimed in claim 2 wherein the lock set reinforcement bracket is provided with a lip for attaching to a side edge of the door to surround a latch plate of a lock set of the door.

4. An apparatus as claimed in claim 1 wherein the door cover steel sheet and the lock set reinforcement bracket are formed from 22 to 24 gauge steel.

5. An apparatus as claimed in claim 4 wherein the door cover steel sheet is formed from 24 gauge steel and the lock set reinforcement bracket is formed from 22 gauge steel.

6. An apparatus as claimed in claim 1 wherein the non-combustible insulating material coating the interior surface of the door cover steel sheet and the lock set reinforcement bracket is selected from the group consisting of ceramics and mineral fibers.

7. An apparatus as claimed in claim 6 wherein the non-combustible insulating material coating the interior surface of the door cover steel sheet and the lock set reinforcement bracket is ceramic paper 1/32 inch thick.

8. A method for increasing the fire rating of an existing door having opposing surfaces, the method comprising attaching to a first surface of an existing door, a door cover steel sheet having a non-combustible insulating coating on an interior surface to cover the entire first surface of the door and attaching to a second surface of the door, a lock set reinforcement bracket having a non-combustible insulating coating on an interior surface to surround at least a lock set opening in the second surface of the door, the modified door having at least a twenty minute fire rating.

9. A method as claimed in claim 8 further comprising providing a folded lip at a top edge of the door cover steel sheet and laying the folded lip over a top edge of the door.

10. A method as claimed in claim 9 further comprising providing the lock set reinforcement bracket with a lip and attaching the lip to the side surface of the door to surround a latch plate of the lock set of a door.

11. A method as claimed in claim 8 wherein the door cover steel sheet and the lock set reinforcement bracket are formed from 22 to 24 gauge steel.

12. A method as claimed in claim 11 wherein the door cover steel sheet is formed from 24 gauge steel and the lock set reinforcement bracket is formed from 22 gauge steel.

13. A method as claimed in claim 8 wherein the non-combustible insulating material coating the interior surface of the door cover steel sheet and the lock set reinforcement bracket is selected from the group consisting of ceramics and mineral fibers.

14. A method as claimed in claim 13 wherein the non-combustible insulating material coating the interior surface of the door cover steel sheet and the lock set reinforcement bracket is ceramic paper 1/32 inch thick.

* * * * *